US007243521B2

(12) United States Patent
Aoshima et al.

(10) Patent No.: US 7,243,521 B2
(45) Date of Patent: Jul. 17, 2007

(54) CUSHION PIN, WEAR PLATE, LOAD SUPPORTING DEVICE, DIE CUSHION, PRESS MACHINE AND PRESSING METHOD

(75) Inventors: Kiyoji Aoshima, Ishikawa (JP); Kiyokazu Baba, Ishikawa (JP)

(73) Assignee: Komatsu Ltd., Tokyo (JP)

( * ) Notice: Subject to any disclaimer, the term of this patent is extended or adjusted under 35 U.S.C. 154(b) by 220 days.

(21) Appl. No.: 10/705,862

(22) Filed: Nov. 13, 2003

(65) Prior Publication Data

US 2004/0094046 A1 May 20, 2004

(30) Foreign Application Priority Data

Nov. 14, 2002 (JP) ..... 2002-331262
May 12, 2003 (JP) ..... 2003-133242

(51) Int. Cl.
*B21D 22/20* (2006.01)

(52) U.S. Cl. ..... 72/351; 267/130

(58) Field of Classification Search ..... 267/130, 267/119; 72/351, 350
See application file for complete search history.

(56) References Cited

U.S. PATENT DOCUMENTS 1,827,440 A * 10/1931 Rode ..... 72/417
3,942,354 A * 3/1976 Randolph, Sr. ..... 72/448
5,197,718 A * 3/1993 Wallis ..... 267/119
5,386,975 A * 2/1995 Wallis ..... 267/119
5,687,598 A * 11/1997 Kirii et al. ..... 72/21.5
5,735,201 A * 4/1998 Hirao et al. ..... 100/269.01
5,960,665 A * 10/1999 Schoellhammer ..... 72/351
6,520,075 B1 * 2/2003 Shinoda et al. ..... 100/214

FOREIGN PATENT DOCUMENTS

FR EP 614711 A1 * 9/1994
JP 5-27215 7/1993

* cited by examiner

*Primary Examiner*—Derris H. Banks
*Assistant Examiner*—Debra M Wolfe
(74) *Attorney, Agent, or Firm*—Wenderoth, Lind & Ponack, L.L.P.

(57) ABSTRACT

An elastic member is disposed on a load supporting device such as cushion pins and wear plates, which are placed between at least a workpiece and a die cushion pad and transfer a load applied to the work to the die cushion pad, to support the load. The load supporting device is disposed in two or more on the die cushion pad to realize equalization of the load applied to a die cushion. Thus, use of a conventional large-scale hydraulic circuit is eliminated, and the device can be simplified. Also, the press machine can be produced at a low cost.

9 Claims, 12 Drawing Sheets

CUSHION PIN, WEAR PLATE, LOAD SUPPORTING DEVICE, DIE CUSHION, PRESS MACHINE AND PRESSING METHOD

BACKGROUND OF THE INVENTION

1. Field of the Invention

The present invention relates to a cushion pin with an elastic member, a wear plate and a load supporting device; to a die cushion for equalizing a cushion pressure by using two or more of them; and further to a press machine having the die cushion. The invention also relates to a pressing method.

2. Description of the Related Art

When the die cushion is used to perform pressing (especially, deep drawing), it is necessary to keep constant a work's blank holding force (cushion pressure) by eliminating poor accuracy (inclination) of a blank holder, variations in length of cushion pins, parallelism error of a die cushion pad for holding the cushion pins, deflection or inclination of a slide of a press machine, and the like. Therefore, a cushion pin pressure-equalizing device is used conventionally. Such a cushion pin pressure-equalizing device is described in, for example, Patent Document 1 (Japanese Utility Model Publication No. 5-27215, pp. 1-2, FIG. 4).

FIG. 15 is a sectional diagram of a press machine using a conventional cushion-equalizing device, showing an example of a cushion pin pressure-equalizing device described in the Patent Document 1. This prior art will be described with reference to FIG. 15.

In FIG. 15, an upper press die 51 is fixed to a slide 52 of the press machine, and a lower press die 53 is fixed to a bolster plate 54. The bolster plate 54 is supported by a carrier (corresponding to a press carrier 55 of Patent Document 1). A blank holder (corresponding to a cushion pad of Patent Document 1) 56 is disposed within the lower press die 53. The blank holder 56 is supported by the top ends of plural cushion pins 57, and the bottom ends of the individual cushion pins 57 are supported by a cushion plate 69 of a die cushion 59 through hydraulic cylinders 58. The die cushion 59 is provided with a cushion cylinder 61 for supporting the cushion plate 69, and a prescribed air pressure, which is determined by an air regulator 63, is supplied from an air pressure source 62 to the cushion cylinder 61 via an air tank 64. The individual hydraulic cylinders 58 are connected to an oil feeding means 67 through a common pipe 65 and a flexible tube 66. The oil feeding means 67 has a function to assure an amount of oil being supplied to the individual hydraulic cylinders 58.

According to the above configuration, a work W is placed on the blank holder 56, the slide 52 is lowered, its lowering force is transmitted to the die cushion 59 through the cushion pins 57, and the die cushion 59 generates a cushion pressure, namely a blank holding force. At this time, an oil pressure generated within each of the hydraulic cylinders 58 disposed at the bottom ends of the cushion pins 57 becomes constant because the individual hydraulic cylinders 58 are mutually communicated. Thus, unbalanced cushion pressures of the individual cushion pins 57 are smoothed (namely, equalized) to improve blank holding accuracy.

But, the above-described conventional cushion pin pressure-equalizing device has the following drawbacks. Specifically, to smooth the unbalanced cushion pressures among the cushion pins 57, it is necessary to provide an equalizing hydraulic circuit, which has the hydraulic cylinders 58 disposed for the individual cushion pins 57 connected to the oil feeding means 67 through the common pipe 65 or an oil passage. Thus, the cushion pin pressure-equalizing device has disadvantages that it becomes large in scale and its cost is high. Besides, a press production site generally has a press machine, which is used for trials to determine pressing conditions in advance before real production. This press machine is in addition to the press machine that is used for the real production. This tryout press machine is also provided with the above-described cushion pin pressure-equalizing device, so that the cost is doubled, and the high cost problem cannot be neglected.

Besides, for pressing with high accuracy, it may be necessary to vary the blank holding force for each portion depending on the shape even if the work is the same. For example, areas D1 to D4 are provided by dividing the portion around the center of the die into four areas as shown in FIG. 16, and four die cushions 59 with different cushion pressures for the individual areas D1 to D4 and the cushion pin pressure equalizing device corresponding to the individual die cushions 59 are provided. Therefore, the cost becomes higher.

The present invention has been made in view of the above circumstances and provides equalization of the cushions without using a large-scale hydraulic circuit and results in reduction of a press machine production cost.

SUMMARY OF THE INVENTION

To achieve the above-described object, a first aspect of the invention relates to cushion pins which are extended through a bolster plate of a press machine, and have their bottom ends disposed on a die cushion through a die cushion pad and hold a work by their top ends directly or through a blank holder. An elastic member for producing a pushing force in an axial direction is provided to enable the work to be held through the elastic member.

According to the first aspect of the invention, the cushion pins are provided with the elastic member for generation of the pushing force in the axial direction and hold the work through the elastic member. If there are variations in cushion pressures because of an inclination of the blank holder, variations in the length of the cushion pins and an error of parallelism of the die cushion pad, the contracted length of the elastic member is varied accordingly, and the length of the cushion pins are reduced. At this time, the contraction in length of the cushion pins smoothes variations in the axial position such as an inclination of the blank holder, variations in the length of the cushion pins and an error of parallelism of the die cushion pad. Also, a difference in pushing force by the elastic member of each of the cushion pins involved in the variations in the axial direction is generated, but the axially transmitted pressures of the individual cushion pins can be equalized by determining an elastic modulus of the elastic member so that a difference in pushing force of the elastic member for each of the cushion pins becomes small with respect to the cushion pressure level. As a result, the equalization can be performed by a simple structure having the elastic member for each of the cushion pins. Thus, the device does not become large in scale, and the production cost can be reduced. Besides, when a different cushion pressure is set for each of the plural areas of the die, only one die cushion is mounted, and a different elastic modulus of the elastic member can be set for each area. Therefore, the cost can be reduced.

A second aspect of the invention relates to a die cushion which equalizes axially transmitted pressures of the individual cushion pins by the cushion pins according to the first aspect of the invention.

A third aspect of the invention relates to a press machine provided with the die cushion according to the second aspect of the invention.

According to the second and third aspects of the invention, the cushion pins having the elastic member can be used to equalize the axially transmitted pressures of the individual cushion pins, and processing accuracy of deep drawing or the like using the die cushion can be improved. Thus, the die cushion and the press machine can be configured at a low cost.

A fourth aspect of the invention relates to a pressing method which performs press work by equalizing axially transmitted pressures of plural cushion pins by smoothing variations in the positions of the ends of the cushion pins by contraction of an elastic member provided for each of the cushion pins disposed on a die cushion through a die cushion pad.

According to the fourth aspect of the invention, the variations in a cushion pin's axial position involved in the variations in working accuracy or rigidity of individual components are smoothed by the contraction of the elastic member provided for each of the cushion pins without using a conventional cushion pin pressure-equalizing device based on a hydraulic circuit including individual hydraulic cylinders which are communicated by a common pipe or oil passage, and the axially transmitted pressures of the individual cushion pins are equalized. Thus, the equalization can be achieved by a simple structure, and the cost can be reduced.

A fifth aspect of the invention relates to a wear plate which is provided with a supporting section having an elastic member and supports a load applied from one direction by the supporting section.

A sixth aspect of the invention relates to a load supporting device which is disposed on one surface of a die cushion pad and supports a load applied from a direction opposite to the surface, wherein a supporting section having an elastic member is provided to support the load.

The fifth and sixth aspects of the invention will be described with reference to FIG. 9.

A sliding section 13, which slides along a bolt member 15 used as a guide, is disposed on one surface of a wear plate (a load supporting device) 11, and an elastic member 16, which produces a pushing force in a direction of the load received from the cushion pin 57 and its opposite direction, is disposed within the sliding section 13. A lid section 14 is disposed on one end of the sliding section 13 so to come into contact with the cushion pin 57. Thus, the load of the slide transmitted through the cushion pin 57 is supported by the sliding section 13, the lid section 14 and the elastic member 16. The other surface of the wear plate 11 is attached to one surface of a die cushion pad 21 and disposed so as to correspond to each cushion pin 57.

The each elastic member 16 contracts depending on variations in length of the individual cushion pins 57, an error in parallelism of the die cushion pad 21, and the like to keep the die cushion pad 21 horizontal. At this time, the individual elastic members 16 have different pushing forces, but the transferred pressures of the individual wear plates 11 can be equalized by setting the elastic modulus of the elastic member 16 so as to reduce the difference in pushing force with respect to the cushion pressure level.

Thus, according to the fifth and sixth aspects of the invention, the equalization can be made by a simple structure having the elastic member on the side of the die cushion pad. Therefore, the hydraulic circuit for equalization can be eliminated, and the equalizing device has a very simple structure. Accordingly, the production cost of the press machine can be reduced.

When a different cushion pressure is determined for each of the plural areas of the die, the difference in cushion pressure produced among the plural areas may be set with the elastic modulus of the individual elastic members differentiated. Therefore, it is advisable to dispose a single die cushion for the press machine, and the production cost of the press machine can be reduced.

Besides, the hydraulic circuit for equalization becomes unnecessary. Thus, oil stains, noise of hydraulic equipment, and the like are reduced, and the work environment at the work site can be improved.

A seventh aspect of the invention relates to a die cushion which receives a load applied through plural cushion pins 57 by a die cushion pad 21, wherein the load supporting device according to the sixth aspect of the invention is provided in two or more on one surface of the die cushion pad, and each cushion pin and each load supporting device are mutually contacted to support the load.

An eighth aspect of the invention relates to a press machine using the die cushion according to the seventh aspect of the invention.

According to the seventh and eighth aspects of the invention, the pressures applied by the cushion pins can be equalized by means of the load supporting device having the elastic member, so that the pressing accuracy of the deep drawing, or the like using the die cushion can be enhanced.

DETAILED DESCRIPTION OF THE PREFERRED EMBODIMENTS

Embodiments of the present invention will be described in detail with reference to the accompanying drawings.

The first to third embodiments will cover cushion pins, a die cushion using the cushion pins and a press machine according to the present invention, and the fourth to eighth embodiments will cover a load supporting device (wear plate), a die cushion using the load supporting device and a press machine.

Figure 1:
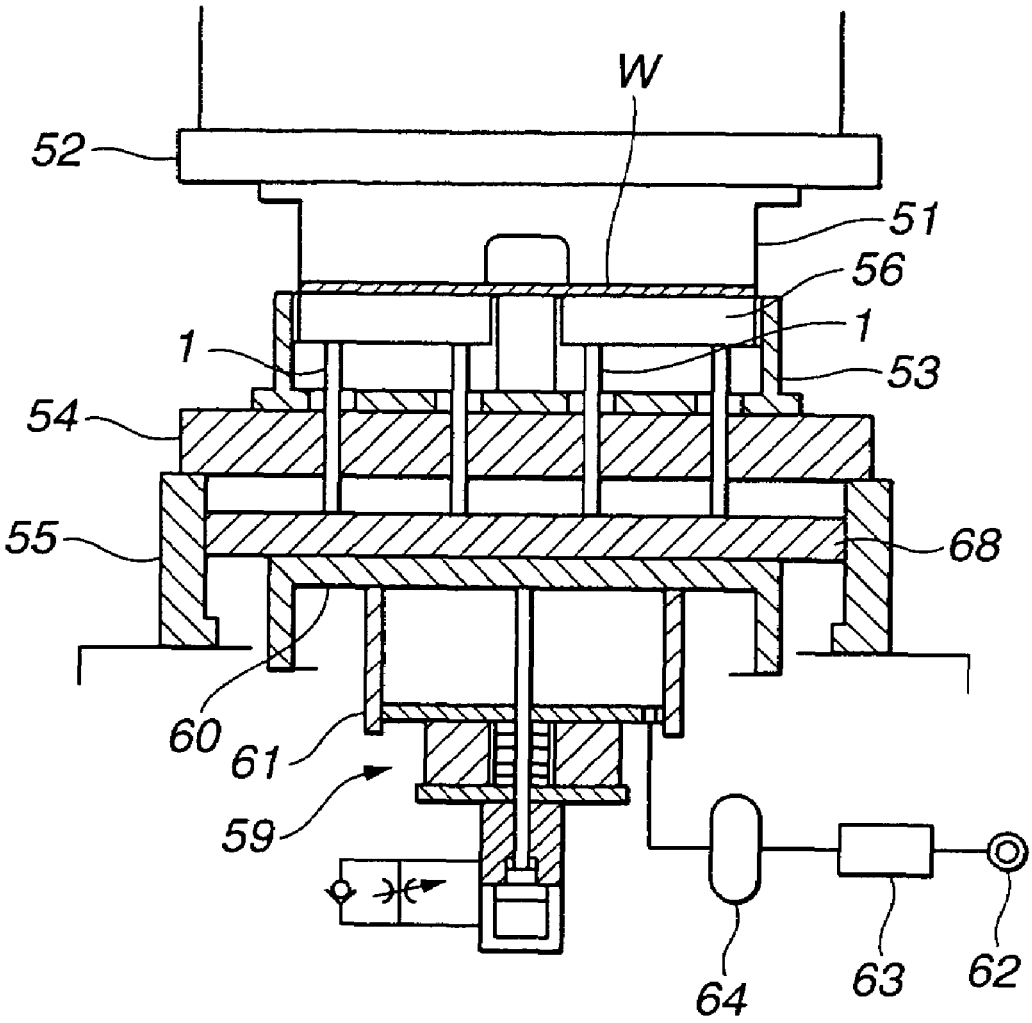
FIG. 1 is a sectional diagram of a press machine having cushion pins according to the present invention.
Figure 15:
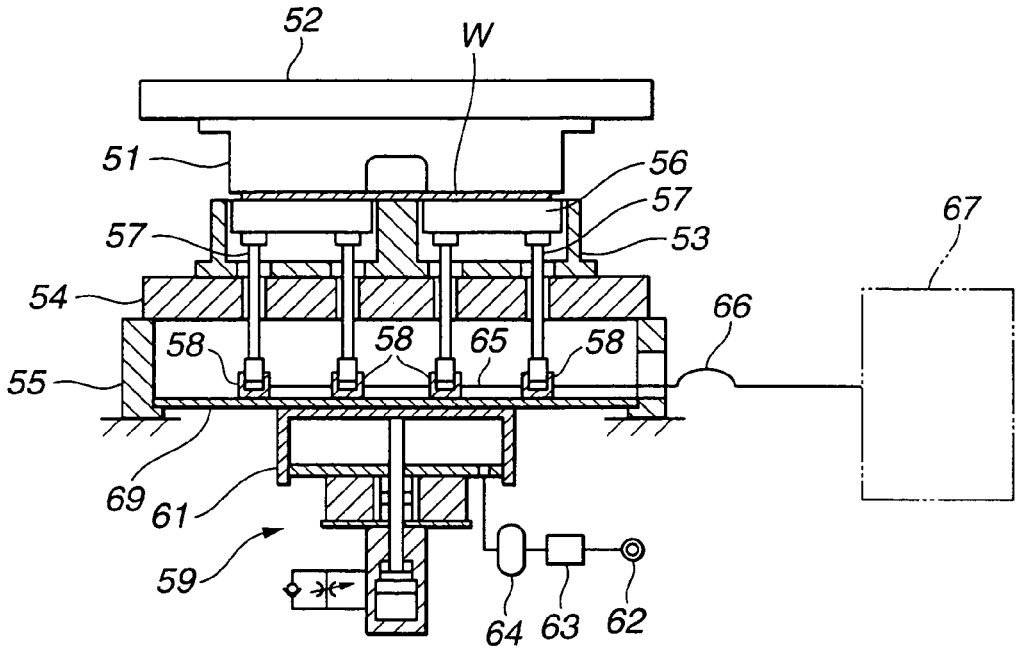
(PRIOR ART) FIG.15
FIG. 15 is a sectional diagram of a press machine using a conventional cushion equalizing device.

FIG. 1 is a sectional diagram of a press machine using the cushion pins according to the invention. Like reference numerals are used to indicate like components such as those shown in FIG. 15 and their descriptions will be omitted.

In FIG. 1, cushion pins 1 are disposed so as to extend through the bolster plate 54, their top ends support the blank holder 56, their bottom ends are supported by a die cushion pad 60, which is attached to the cushion cylinder 61 of the die cushion 59, via a pad 68.

Figure 2:
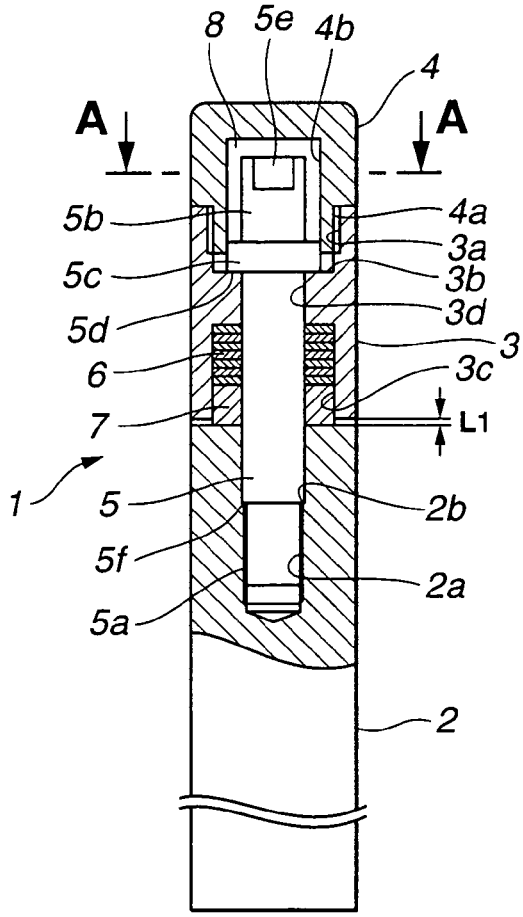
FIG. 2 is a partially sectional side view of the cushion pin according to a first embodiment.
Figure 3:
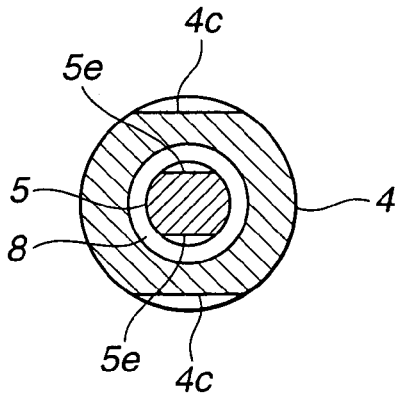
FIG. 3 is a sectional diagram taken along line A-A of FIG. 2.

FIG. 2 is a partially sectional side view of the cushion pin according to the first embodiment, and FIG. 3 is a sectional diagram taken along line A-A of FIG. 2. The cushion pin 1 will be described with reference to FIGS. 2 and 3. The cushion pin 1 has a first member 2, a sliding member 3 and a second member 4. The first member 2 is a solid pillar (a cylindrical shape in this embodiment), and a screw hole 2*a* is formed in the axial direction at substantially the center of one end. Also, the sliding member 3 is a hollow pillar (a cylindrical shape in this embodiment) and has a screw hole section, which has a female thread 3*a* at substantially the center, formed at one end, and a through hole 3*d* having a diameter smaller than the inside diameter of the female thread 3*a* formed in a bottom 3*b* of the screw hole section substantially perpendicular to the screw axis. Besides, a cylindrical hole 3*c* which is larger than the through hole 3*d* and communicated with the through hole 3*d* is formed at substantially the center of the other end of the sliding member 3. Within the hole 3*c* are housed a ring-shaped elastic member 6 and a ring-shaped spacer 7 in this order from the inner part of the hole. The elastic member 6 is formed of an elastic material such as a coned disc spring, a spring or a rigid urethane material which produces a pushing force when it is contracted in its axial direction to have a short length, and it is comprised of the coned disc spring in this embodiment. The bolt member 5 is slidably inserted from the second member 4 of the sliding member 3 to extend through the through hole 3*d*, the ring-shaped elastic member 6 and the ring-shaped spacer 7 in this order, and a threaded portion 5*a* of the leading end of the bolt member 5 is screwed into the screw hole 2*a* of the first member 2. The bolt member 5 has a small-diameter head 5*b* on its end opposite to the threaded portion 5*a* and a large-diameter head 5*c* on the side of the axial center from the small-diameter head 5*b*, and also has a small-diameter intermediate portion, which is smaller than the large-diameter head 5*c*, between the large-diameter head 5*c* and the threaded portion 5*a*. And, when the bolt member 5 is screwed into the first member 2, a stepped end face 5*d* formed on the small-diameter intermediate portion of the large-diameter head 5*c* comes into contact with a bottom face 3*b* of the screw hole section of the sliding member 3 to push the elastic member 6 through the sliding member 3 so to produce a prescribed pushing force in the axial direction.

Here, the bolt member 5 is screwed into the first member 2 so that a stepped end face 5*f* between the small-diameter intermediate portion of the bolt member 5 and the threaded portion 5*a* comes into contact with the stepped end face 2*b* of the screw hole 2*a* of the first member 2, and the sliding member 3 is pushed by the pushing force of the elastic member 6 against the stepped end face 5*d* of the large-diameter head 5*c* of the bolt member 5. At this time, it is configured in such a way that a gap with a prescribed distance L1 is formed between the end face of the sliding member 3 and the end face of the first member 2. This distance L1 may be determined to be a distance having an allowance for the displacement of the elastic member 6, so that when a prescribed cushion pressure is added to the cushion pin 1, the pushing force corresponding to the contracted length (displaced amount) of the elastic member 6 and the cushion pressure can be balanced considering an elastic modulus of the elastic member 6. And, it may be set to a distance to provide an allowance for the displacement of the elastic member 6, and to, for example, approximately 0.1 to 0.2 mm according to the analysis made by the applicant.

Meanwhile, the second member 4 has a substantially pillar shape (a cylindrical shape in this embodiment), its one end has an external thread 4*a* having the same diameter as that of the female thread 3*a* of the sliding member 3 formed on the outer peripheral surface, and its substantially center section has a hole 4*b* having a diameter slightly larger than that of the large-diameter head 5*c* of the bolt member 5. When the external thread 4*a* of the second member 4 is screwed into the female thread 3*a* of the sliding member 3, the hole 4*b* of the second member 4 is slidably inserted on the outer peripheral surface of the large-diameter head 5*c* of the bolt member 5, and a grease chamber 8 is formed between the inner peripheral surface of the hole 4*b* of the second member 4 and the outer peripheral surface of the small-diameter head 5*b* of the bolt member 5. Grease is filled into the grease chamber 8 through an unshown injection port.

Two mutually parallel cut end faces 5*e*, 5*e* are formed on the outer peripheral surface of the small-diameter head 5*b* of the bolt member 5, and two mutually parallel cut end faces 4*c*, 4*c* are also formed on the outer peripheral surface of the second member 4. These cut end faces 5*e*, 5*e* and 4*c*, 4*c* are used to fit a tool such as a spanner at the time of removal or attachment.

As to the vertical direction of attaching the cushion pin 1, either the first member 2 or the second member 4 may be positioned on the upper side.

The operation of the above structure will be described with reference to FIG. 1 and FIG. 2.

When the slide 52 of the press machine is lowered, the upper press die 51 comes into contact with the work W which is positioned on the blank holders 56, and the outer edge of the work W is held between the upper press die 51 and the blank holders 56. Then, the upper press die 51 pushes the cushion pins 1 and the die cushion 59 through the blank holders 56 to lower together with the cushion pins 1 and the die cushion 59 and presses the work W between the upper press die 51 and the lower press die 53. At this time, the load applied when the slide lowers is transmitted to the individual cushion pins 1 through the blank holders 56 and integrally pushes the second member 4 and the sliding member 3 of the each cushion pin 1 to slide with the bolt member 5 used as a guide, thereby contracting the elastic member 6.

The contraction of the elastic member 6 smoothes variations in the position in the axial direction of the cushion pins including an inclination of the blank holders 56, variations in the length of the cushion pins 1 and an error of parallelism of the die cushion pad 60, and the contracted length of the elastic member 6 is determined according to the variations in the axial positions of the cushion pins. And, a pushing force corresponding to the contracted length of each elastic member 6 is generated for each cushion pin 1, and the variations in the pushing force of the elastic member 6 of each cushion pin 1 correspond to the variations in the cushion pressure of each cushion pin 1. Here, the axially transmitted pressures of the individual cushion pins 1 are equalized by setting an elastic modulus of the elastic member 6 so that the variation in the pushing force of the elastic member 6 becomes so small that it can be neglected in view of the predetermined cushion pressure of the die cushion 59. Thus, the blank holding forces of the individual cushion pins 1 can be made substantially constant, and pressing accuracy can be improved.

Figure 4:
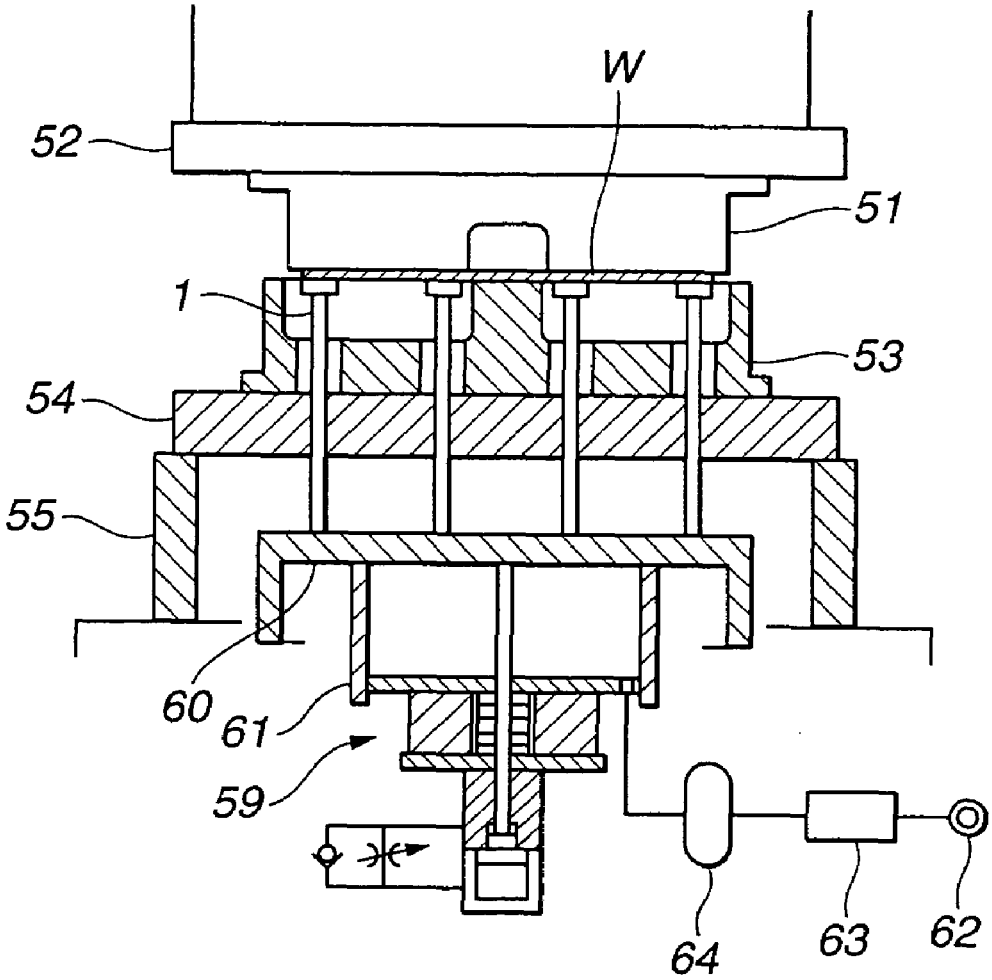
FIG. 4 is a sectional diagram of a press machine of an embodiment different from FIG. 1.

As shown in FIG. 4, the top ends of the cushion pins 1 may directly contact the work W, and their bottom ends may directly contact the die cushion pad 60.

The entire shape of the cushion pin 1 is not required to be cylindrical but may be formed to have, for example, a partly large diameter at the top end as shown in FIG. 4.

By configuring as described above, the die cushion equalizes the pin cushion pressure by using the cushion pins 1 having the elastic member 6 which produces a pushing force in the axial direction. Therefore, a hydraulic circuit for equalization is unnecessary, the equalizing device has a very simple structure, and the production cost becomes low. When a different cushion pressure is set for each of the plural areas (D1 to D4) of the die as described above, only one die cushion is mounted to determine the main cushion pressure level, and a difference in cushion pressure among the plural areas is dealt with by appropriately setting the elastic modulus of the elastic member 6 which varies for each of the areas. Thus, the cost can be lowered. Besides, a hydraulic circuit for equalization is unnecessary, oil stains, noise of hydraulic equipment, and the like are reduced, and the work environment of the work site can be improved.

Figure 5:
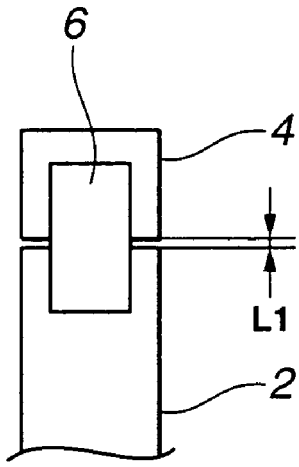
FIG. 5 is a partially sectional side view of a cushion pin according to a second embodiment.
Figure 6:
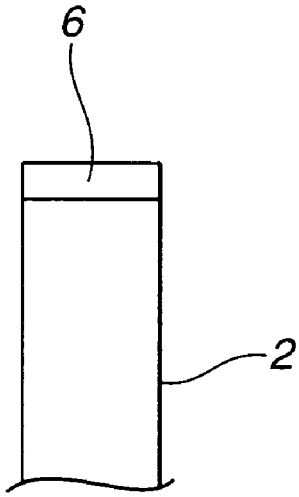
FIG. 6 is a partially sectional side view of a cushion pin according to a third embodiment.

The cushion pin according to the present invention is not limited to the structure of the first embodiment but may have a structure of, for example, the second embodiment or the third embodiment as shown in FIG. 5 or FIG. 6. In FIG. 5, the elastic member 6 is disposed between the first member 2 and the second member 4, and the elastic member 6 is fitted into the holes of the first member 2 and the second member 4 for fixation. The cushion pin shown in FIG. 6 has the elastic member 6 fixed to one end of the first member 2. In either case, variations in the axial position of the each cushion pin can be smoothed by the contraction of the elastic member 6 to equalize the axially transmitted pressures of the individual cushion pins. Thus, the same effects as in the above-described embodiment can be obtained.

As described above, the following effects can be obtained by the first to third embodiments.

The cushion pins having the elastic member for producing the pushing force in the axial direction are used to configure the die cushion for equalization of the axially transmitted pressures of the individual cushion pins. Thus, the equalizing device has a very simple structure and can be produced at a low cost. And, a different cushion pressure can be set for each of the plural areas of the die by appropriately determining a different elastic modulus of the elastic member for the individual areas, so that the cost can be reduced.

And, a hydraulic circuit for equalization is unnecessary, oil stains, noise of hydraulic equipment, and the like are reduced, and the work environment at the work site can be improved.

Figure 7:
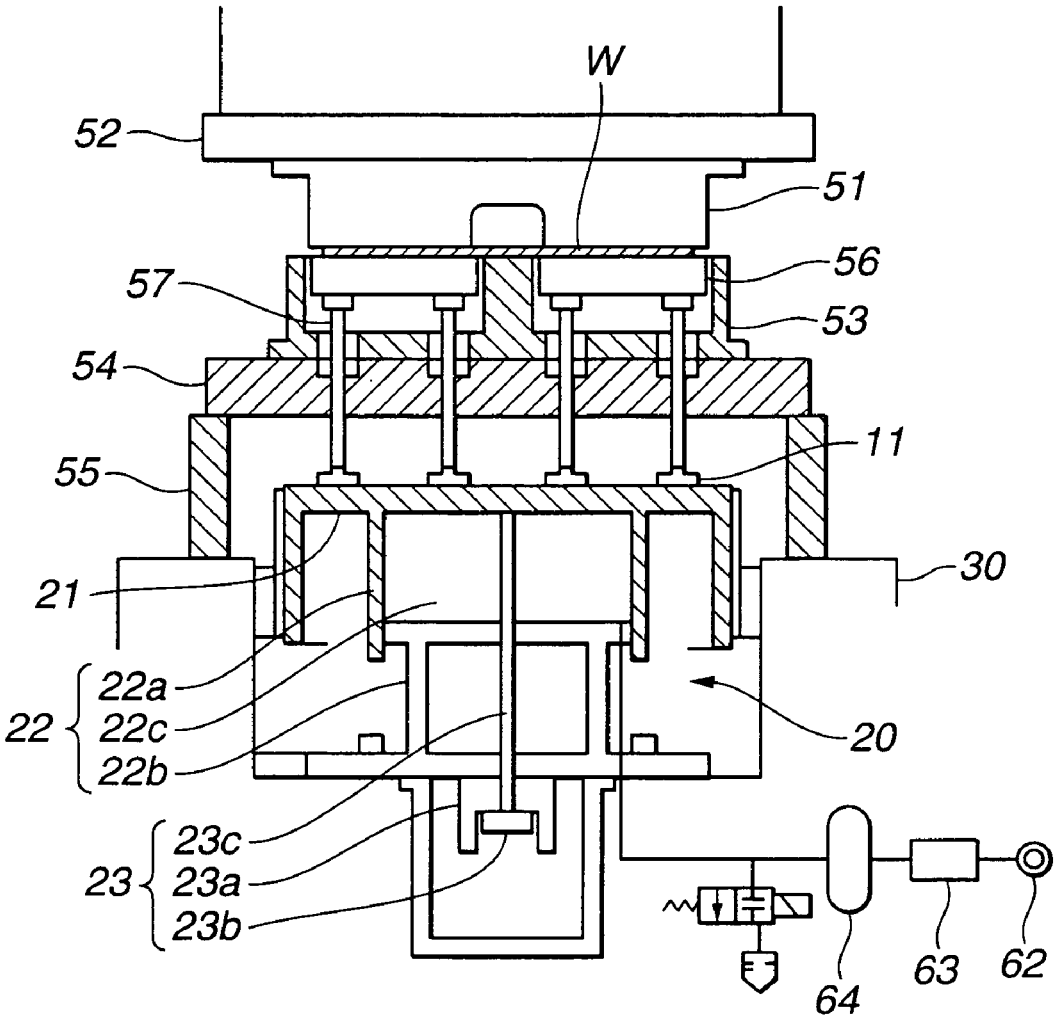
FIG. 7 is a sectional diagram of a press machine using a load supporting device according to the invention.

FIG. 7 is a sectional view of a press machine using the load supporting device according to the present invention.

The press machine shown in FIG. 7 has a wear plate as the load supporting device. Like reference numerals are used for like components as those shown in FIG. 15, and their descriptions will be omitted.

As shown in FIG. 7, the press machine has the work W to be pressed placed between the upper press die 51 on the slide 52 side and the lower press die 53 on the bolster plate 54 side. The bottom of the work W is supported by the plural cushion pins 57. The individual cushion pins 57 are extended through the lower press die 53 and the bolster plate 54 so as to have one end in contact with the work W through the blank holder 56, and the other end in contact with the wear plate 11 on the die cushion pad 21. The bolster plate 54 is supported by the frame 30 through the carrier 55.

The die cushion 20 is disposed on the frame 30 side. The die cushion 20 is roughly comprised of a die cushion pad 21, a cushion cylinder section 22 and a stopper section 23. The plural wear plates 11 corresponding to the individual cushion pins 57 are disposed on the surface of the die cushion pad 21 opposed to the bolster plate 54. The individual cushion pins 57 are supported by the corresponding wear plates 11. And, the other surface of the die cushion pad 21 is supported by the cushion cylinder section 22.

The cushion cylinder section 22 is comprised of the cylinder 22*a* formed on the die cushion pad 21 and the piston 22*b* formed on the frame 30. The piston 22*b* is slidably inserted into the cylinder 22*a*, and a pressure chamber 22*c* is formed by the inner surface of the cylinder 22*a* and the end face of the piston 22*b*. A prescribed air pressure determined by an air regulator 63 is supplied from the air pressure source 62 to the pressure chamber 22*c* through the air tank 64.

The stopper section 23 is comprised of a cylinder 23*a* and a nut 23*b*. The nut 23*b* and the die cushion pad 21 are mutually connected by a rod 23*c*. The nut 23*b* is slidably inserted into the cylinder 23*a*. Operating oil is filled into the cylinder 23*a*, and when the nut 23*b* slides within the cylinder 23*a* with the operation of the die cushion pad 21, the operating oil is reduced by the cylinder 23*a* and the nut 23*b*. Therefore, the die cushion pad 21*a* is gently stopped at the top dead center.

Figure 8:
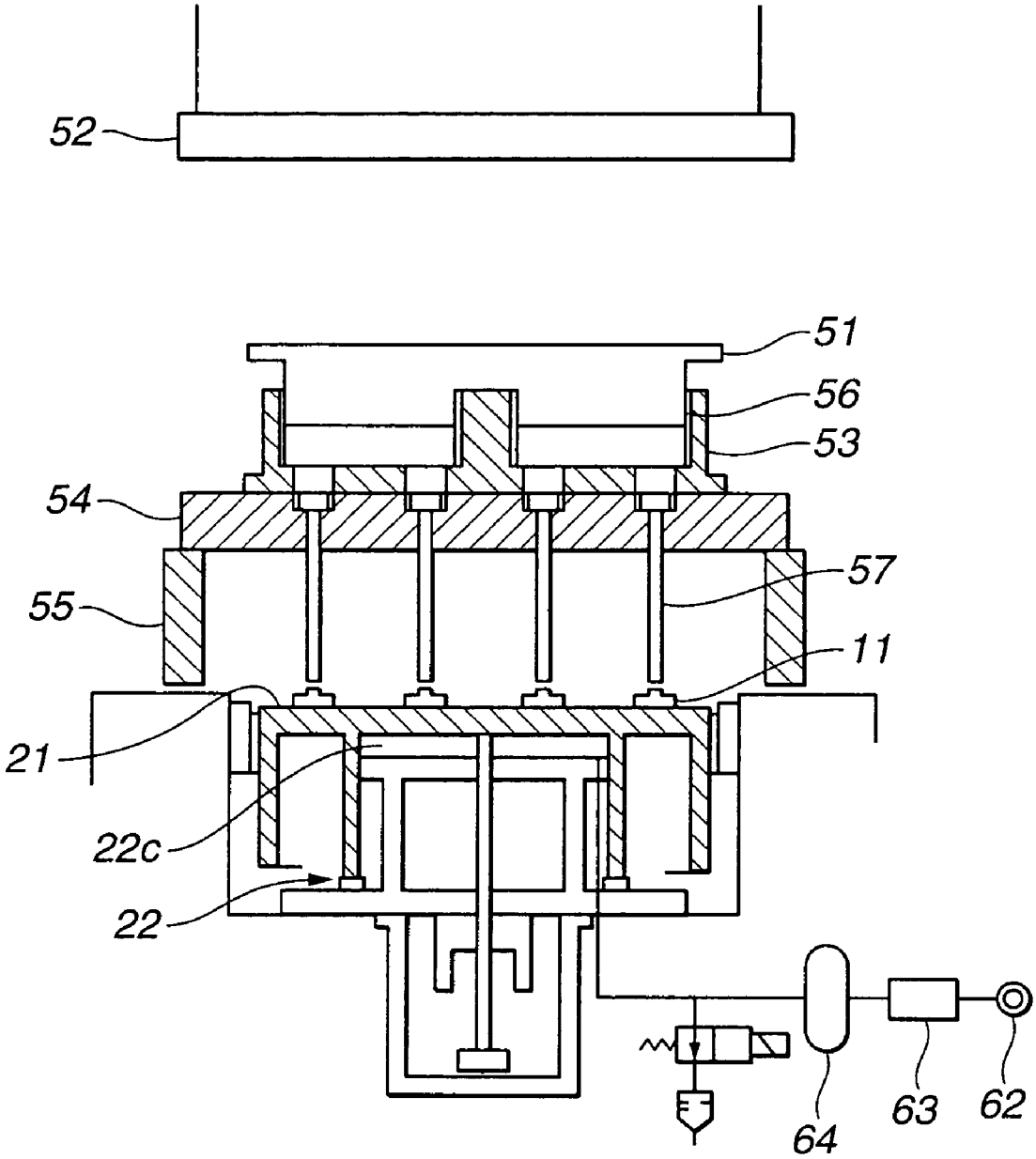
FIG. 8 is a sectional diagram of the press machine using the load supporting device according to the invention.

FIG. 8 is a sectional view of a press machine having the load supporting device according to the present invention.

FIG. 7 shows a state of the work W set in position, while FIG. 8 shows a state of die carry-in-and-out. At the time of the die carry-in-and-out, the air in the pressure chamber 22*c* of the cushion cylinder section 22 is discharged, and the die cushion pad 21 is positioned at the bottom end. In this state, the cushion pins 57 and the wear plates 11 are separated from one another. At the time of die carry-out, the carrier 55 is removed from the frame 30, and the upper press die 51, the lower press die 53, the bolster plate 54, the carrier 55, the blank holder 56 and the cushion pins 57 are integrally removed. At the time of die carry-in, the upper press die 51, the lower press die 53, the bolster plate 54, the carrier 55, the blank holder 56 and the cushion pins 57 are integrally carried in, and the carrier 55 is attached to the frame.

Figure 9:
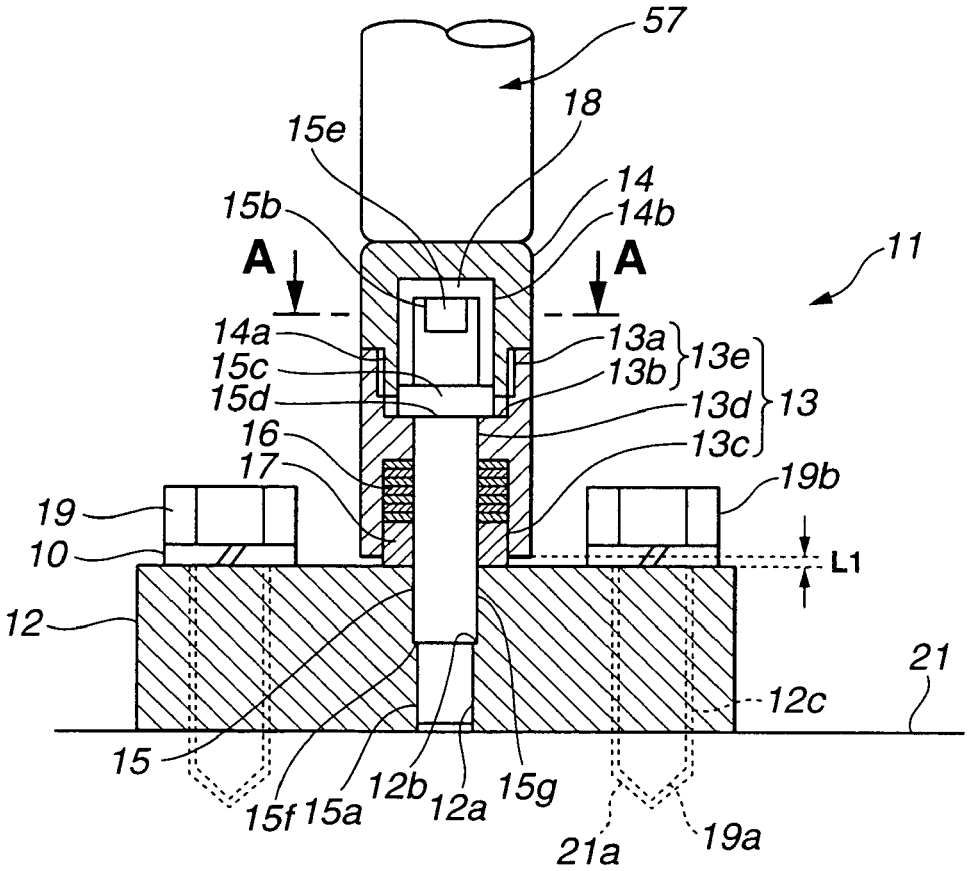
FIG. 9 is a partially sectional side view of a load supporting device according to a fourth embodiment.
Figure 10:
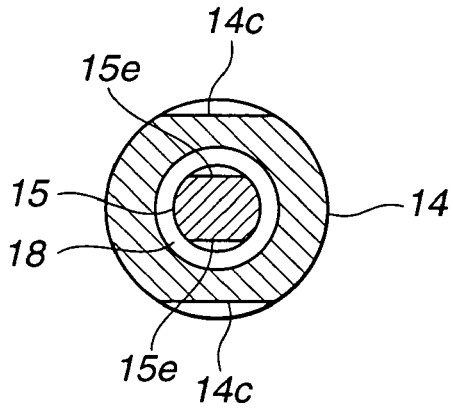
FIG. 10 is a sectional diagram taken along line A-A of FIG. 9.

FIG. 9 is a partially sectional side view of the load supporting device according to the fourth embodiment, and FIG. 10 is a sectional view taken along line A-A of FIG. 9.

The wear plate 11 will be described with reference to FIG. 9 and FIG. 10. The wear plate 11 has a plate section 12, a slide section 13 and a lid section 14.

The plate section 12 is made of a plate member, and its material has hardness of a level adequate to prevent a hole from being formed when it is contacted by the slide section 13. The plate section 12 is formed with a screw hole 12*a* having a ring-shaped stepped end face 12*b* in it and two or more bolt holes 12*c*, which are formed in the same direction as that of the center axis of the screw hole 12*a*. The screw hole 12*a* has a large diameter portion on the opening side from the stepped end face 12*b*. A threaded portion 19*a* is formed on one end of the bolt 19, and a head section 19*b* is formed on the other end. Screw holes 21*a* are formed on the surface of the die cushion pad 21. The threaded portion 19*a* of the bolt 19 is extended through a washer 10 and the bolt hole 12*c* of the plate section 12 and screwed into the screw hole 21*a* of the die cushion pad 21. Then, the plate section 12 is attached to the die cushion pad 21 by the pressure of the bolt head 19*b* transmitted via the washer 10.

The slide section 13 is formed of a pillar (a cylindrical shape in this embodiment) member. A screw hole section 13*e*, which has a bottom 13*b* and a female thread 13*a* formed on the inner peripheral surface, is formed in one end of the slide section 13. A cylindrical hole 13*c* is formed in the other end, and a through hole 13*d* which connects the screw hole section 13*e* and the hole 13*c* is also formed. The screw hole section 13*e*, the hole 13*c* and the through hole 13*d* have the same center axis, and the screw hole section 13*e* and the hole 13*c* have a diameter that is larger than that of the through hole 13*d*. In the hole 13*c*, the ring-shaped elastic member 16 and the ring-shaped spacer 17 are housed in this order from its inner part. The elastic member 16 is formed of an elastic material such as a coned disc spring, a spring or a rigid urethane material which produces a pushing force when it is contracted in the axial direction. The elastic member 16 of this embodiment is a coned disc spring.

A threaded portion 15*a* is formed on one end of the bolt member 15, a small-diameter head 15*b* is formed on the other end, and a large-diameter head 15*c* is formed on the center side in the axial direction from the small-diameter head 15. A ring-shaped stepped end face 15*d* is formed on the middle in the axial direction of the surface of the large-diameter head 15*c*. An intermediate portion 15*g*, which has a diameter smaller than that of the large-diameter head 15*c* and slightly larger than that of the threaded portion 15*a*, is formed between the large-diameter head 15*c* and the threaded portion 5*a*. A ring-shaped stepped end face 15*f* is formed on the joint between the intermediate portion 15*g* and the threaded portion 15*a*.

The bolt member 15 is slidably inserted into the through hole 13*d*, the ring-shaped elastic member 16 and the ring-shaped spacer 17 in this order from the screw hole section 13*e* of the slide section 13. The threaded portion 15*a* on its leading end is screwed into the screw hole 12*a* of the plate section 12. Thus, the stepped end face 15*d* of the bolt member 15 comes into contact with the bottom face 13*b* of the slide section 13. From this state, the threaded portion 15*a* is further screwed so to contact the stepped end face 15*f* of the bolt member 15 with the stepped end face 12*b* of the plate section 12. In this state, the stepped end face 15*d* of the bolt member 15 pushes the elastic member 16 through the slide section 13, so that a pushing force is produced in the axial direction of the bolt member 15. In other words, the slide section 13 is pushed against the stepped end face 15*d* of the bolt member 15 by the pushing force of the elastic member 16.

The plate section 12, the slide section 13, the bolt member 15, the elastic member 16 and the spacer 17 are designed to have their individual dimensions, so that a gap of a prescribed distance L1 is formed between the end face of the slide section 13 and the end face of the plate section 12 by the produced pushing force. The distance L1 may be determined to be a distance that provides an allowance for displacement of the elastic member 16, so that when a prescribed cushion pressure is applied to the cushion pin 57, a pushing force corresponding to a contracted length (displaced amount) of the elastic member 16 and a cushion pressure can be balanced in view of an elastic modulus of the elastic member 16. According to the analysis performed by the applicant, the distance L1 is desired to be, for example, about 0.1 to 0.2 mm.

The lid section 14 is formed of a pillar (a cylindrical shape in this embodiment) member. The external thread 14*a* having the same diameter as the diameter of the female thread 13*a* of the slide section 13 is formed on the outer peripheral surface of one end of the lid section 14. A hole 14*b* having a diameter slightly larger than that of the large-diameter head 15*c* of the bolt member 15 is formed at substantially the center. When the external thread 14*a* of the lid section 14 is screwed in the female thread 13*a* of the slide section 13, the hole 14*b* of the lid section 14 is slidably inserted on the outer peripheral surface of the large-diameter head 15*c* of the bolt member 15, and the grease chamber 18 is formed between the inner peripheral surface of the hole 14*b* of the lid section 14 and the outer peripheral surface of the small-diameter head 15*b* of the bolt member 15. Grease is supplied into the grease chamber 18 through an unshown injection port. The end of the cushion pin 57 comes into contact with the other end of the lid section 14.

As shown in FIG. 10, two mutually parallel cut end faces 15*e*, 15*e* are formed on the outer peripheral surface of the small-diameter head 15*b* of the bolt member 15, and two mutually parallel cut end faces 14*c*, 14*c* are similarly formed on the outer peripheral surface of the lid section 14. These cut end faces 15*e*, 15*e* and 14*c*, 14*c* are used to fit a tool such as a spanner at the time of removal or attachment.

The operation of the above structure will be described with reference to FIG. 7 and FIG. 9.

When the slide 52 of the press machine is lowered, the upper press die 51 comes into contact with the work W. The upper press die 51 pushes the work W, the blank holder 56, the cushion pin 57, the wear plate 11 and the die cushion pad 21 and lowers together with the work W, the blank holder 56, the cushion pin 57, the wear plate 11 and the die cushion pad 21 to form the work W between the upper press die 51 and the lower press die 53. The load applied when the slide 52 lowers is transmitted to the individual wear plates 11 which support the cushion pins 57. The load pushes the lid section 14 and the slide section 13 of the wear plate 11 against the plate section 12 to slide with the bolt member 15 functioning as a guide. At this time, the elastic member 16 is contracted.

When the elastic member 16 is contracted, variations in axial position of the cushion pins including variations in the length of the cushion pins 57 and parallelism error of the die cushion pad 21 are smoothed. The contracted length of the elastic member 16 is determined depending on the variations in the axial position of the cushion pins. And, a pushing force is produced according to the contracted length of the each elastic member 16 for each of the wear plates 11, and the variations in the pushing forces of the elastic members 16 of the individual wear plates 11 correspond to the variations in the cushion pressures of the individual wear plates 11. Here, when the elastic modulus of the elastic member 16 is set so that the variations in the pushing forces of the elastic members 16 become small to a level negligible with respect to the prescribed cushion pressure level of the die cushion 20, the transferred pressures of the individual wear plates 11 are equalized. Thus, the blank holding forces of the individual cushion pins 57 can be made substantially constant, and pressing accuracy can be improved.

The top ends of the cushion pins 57 may directly contact the work W.

And, the slide section 13 and the lid section 14 of the wear plate 11 are not required to have a cylindrical shape, and the lid section 14 may have a diameter that is larger than that of the slide section 13.

According to the fourth embodiment, the die cushion is configured to equalize the cushion pressure through the wear plate 11 having the elastic member 16 for producing the pushing force in the direction of the load receiving from the cushion pin 57 and its opposite direction, so that the hydraulic circuit for equalization is unnecessary, and the equalizing device has a very simple structure. Thus, the press machine production cost can be reduced.

Figure 16:
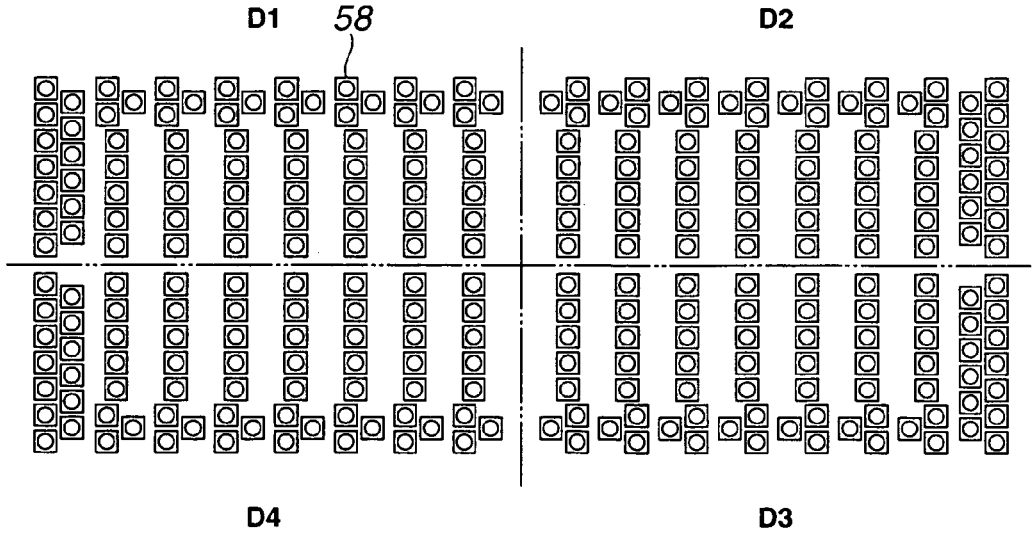
(PRIOR ART) FIG.16
FIG. 16 is an example arrangement of hydraulic cylinders of a conventional cushion equalizing device.

As shown in FIG. 16, when a different cushion pressure is determined for the plural areas (D1 to D4) of the die, the main cushion pressure is determined by the cushion cylinder section 22 of the die cushion 20, and a cushion pressure difference produced among the plural areas may be determined with an elastic modulus of the elastic members 6 of the individual wear plates 11 differentiated. Therefore, the press machine is desirably provided with a single die cushion, and the press machine production cost can be reduced.

Besides, the hydraulic circuit for equalization is unnecessary, so that oil stains, noise of hydraulic equipment, and the like are reduced, and the work environment at the work site can be improved.

Figure 11:
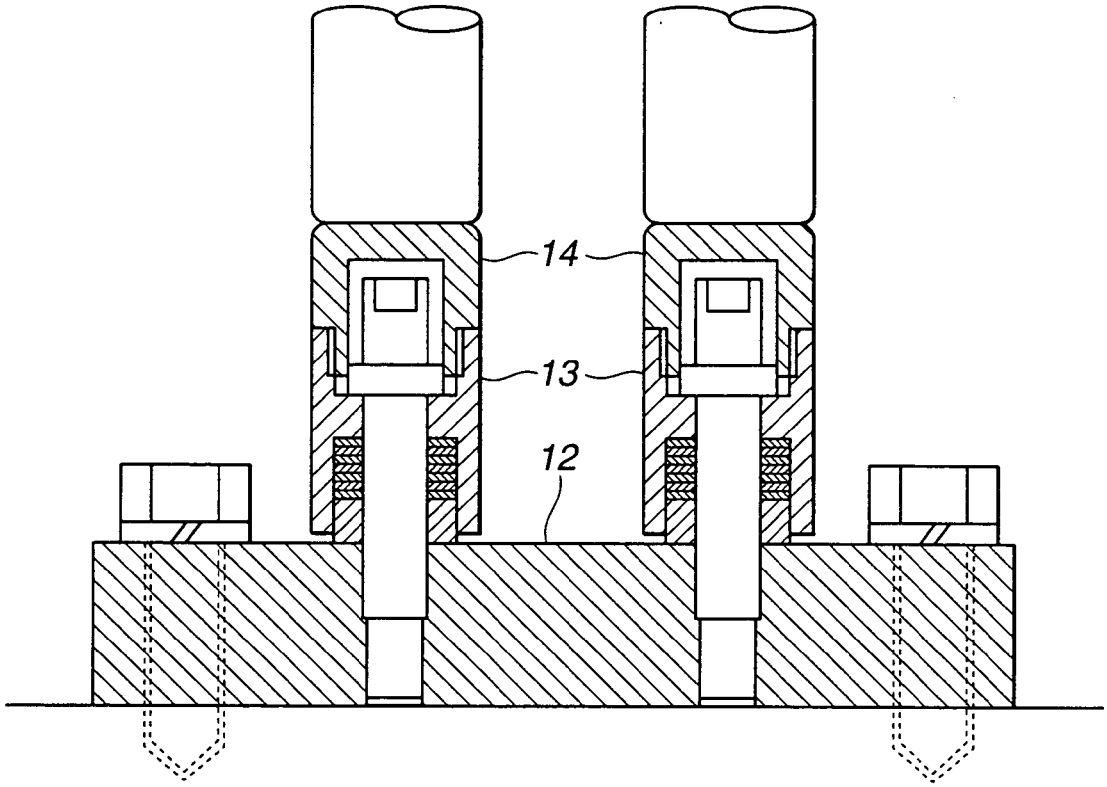
FIG. 11 is a partially sectional side view of a load supporting device according to a fifth embodiment.

FIG. 11 is a partially sectional side view of the load supporting device according to the fifth embodiment.

The fifth embodiment has plural slide sections 13 and lid sections 14 on a single plate section 12. The slide section 13 and the lid section 14 are configured in the same way as in the fourth embodiment.

Figure 12:
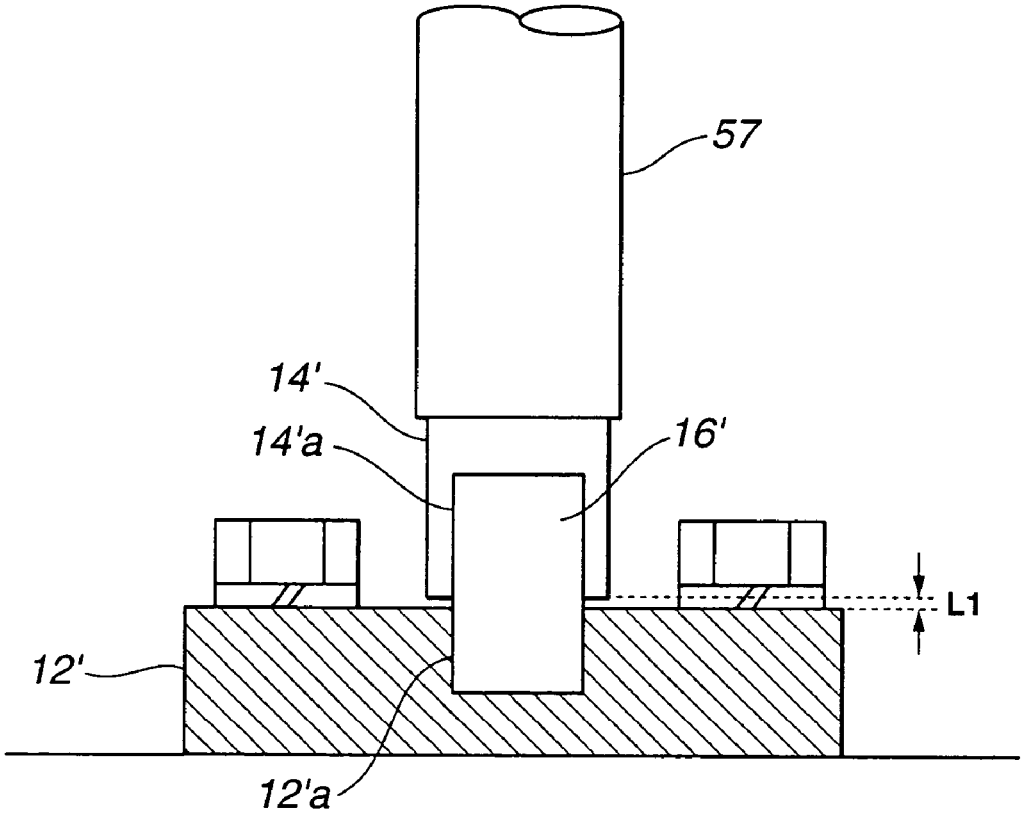
FIG. 12 is a partially sectional side view of a load supporting device according to a sixth embodiment.

FIG. 12 is a partially sectional side view of the load supporting device according to the sixth embodiment.

The sixth embodiment uses a cylindrical rigid urethane 16' as the elastic member. One end of the rigid urethane 16' is fitted into a hole 12'*a* formed in a plate section 12', and one end face of the rigid urethane 16' comes into contact with the bottom of the hole 12'. Meanwhile, the other end of the rigid urethane 16' is fitted into a hole 14'*a* formed in a lid section 14', and the other end face of the rigid urethane 16' comes into contact with the bottom of the hole 14'*a*. In this state, a gap with a prescribed distance L1 is formed between one end face of the lid section 14' and one end face of the plate section 12'. The other end face of the lid section 14' comes into contact with the cushion pin 57.

Figure 13:
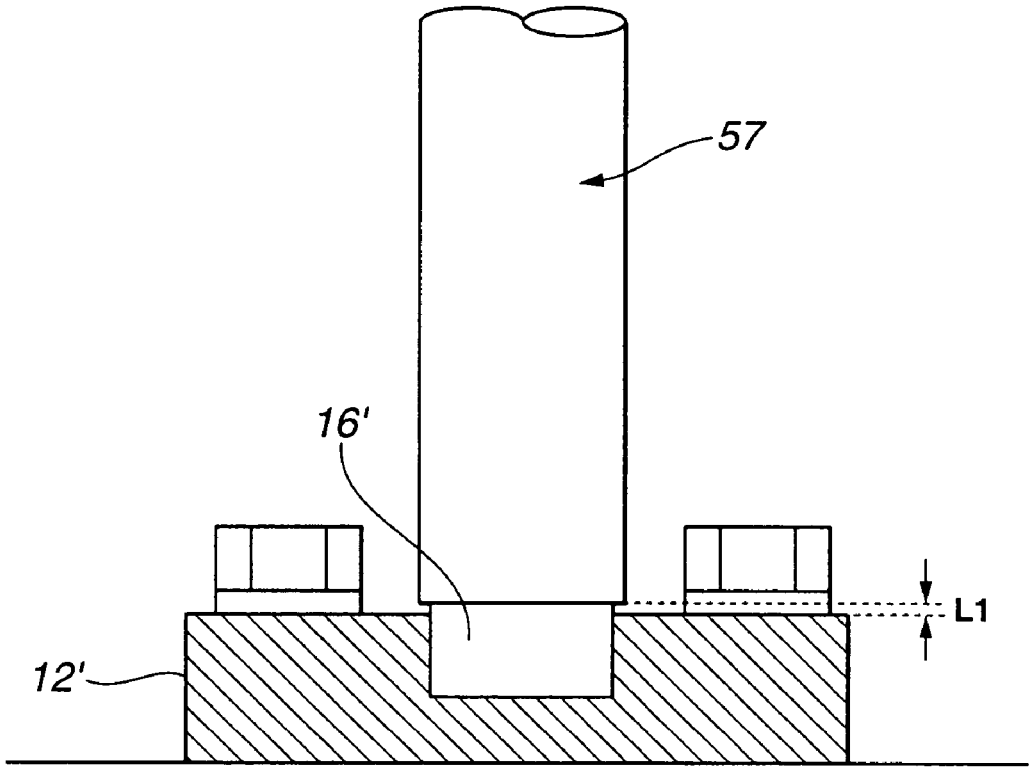
FIG. 13 is a partially sectional side view of a load supporting device according to a seventh embodiment.

FIG. 13 is a partially sectional side view of the load supporting device according to the seventh embodiment.

The seventh embodiment also uses a cylindrical rigid urethane 16' as the elastic member in the same way as in the sixth embodiment, but an end face of the rigid urethane 16' is in direct contact with the cushion pin 57 without mounting a lid section in the seventh embodiment. In this state, a gap with a prescribed distance L1 is formed between the end face of the cushion pin 57 and one end face of the plate section 12'. The rigid urethane 16' has a diameter that is smaller than that of the cushion pin 57. But, the rigid urethane 16' may have a diameter that is larger than that of the cushion pin 57. In this case, it is not necessary to have a gap between the end of the cushion pin 57 and one end face of the plate section 12'.

Figure 14:
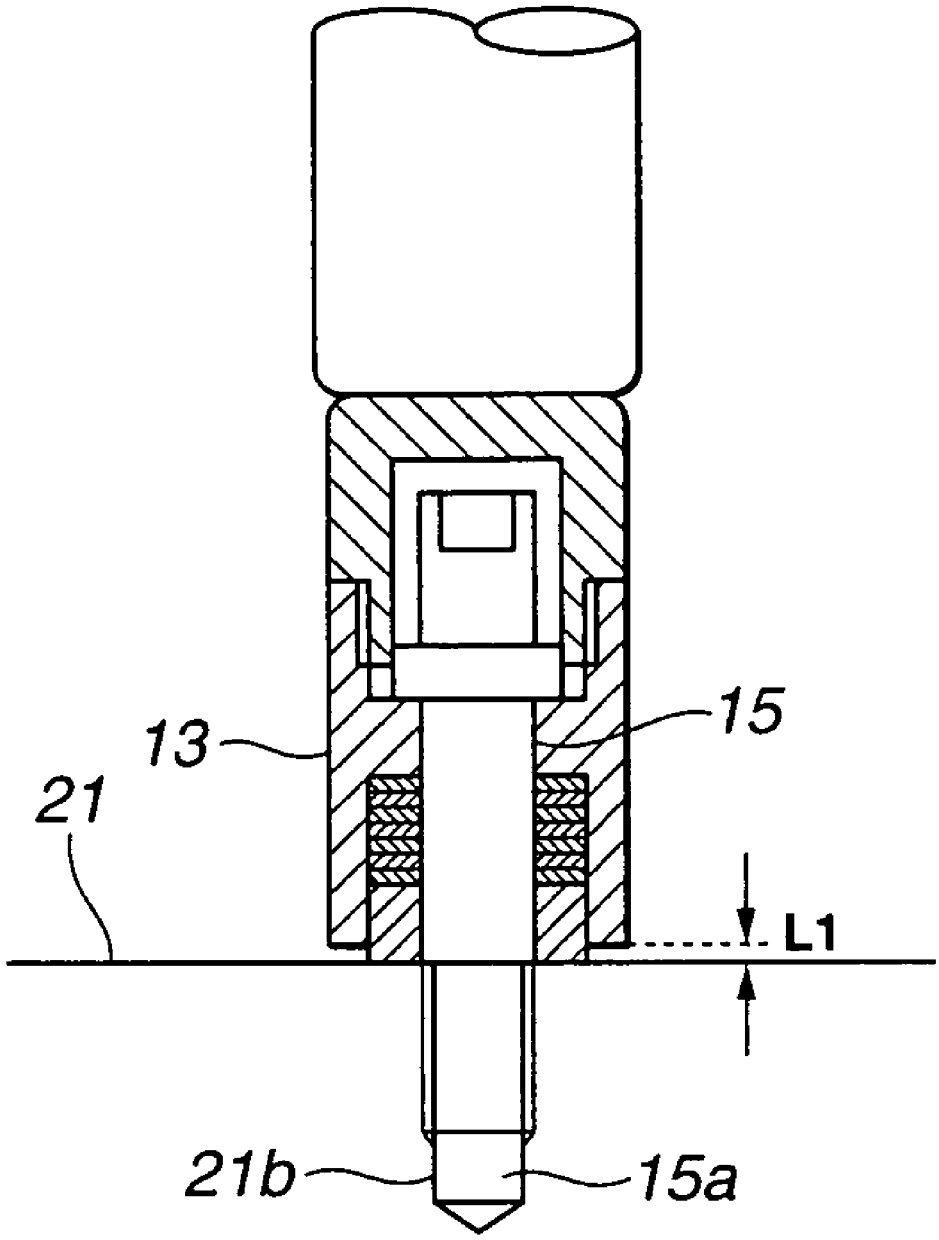
FIG. 14 is a partially sectional side view of a load supporting device according to an eighth embodiment.

FIG. 14 is a partially sectional side view of the load supporting device according to the eighth embodiment.

The eighth embodiment does not have the plate section 12 of the fourth embodiment, and the bolt member 15 is directly screwed in the die cushion pad 21. The threaded portion 15*a* of the bolt member 15 is screwed in the screw hole 21*b* formed in the surface of the die cushion pad 21. In this state, a gap with a prescribed distance L1 is formed between an end face of the slide section 13 and a surface of the die cushion pad 21. In this case, it is necessary to make the surface of the die cushion pad 21 rigid to a level adequate to prevent a hole from being formed by the contact with the slide section 13.

The same effects as in the fourth embodiment can also be obtained by the fifth to eighth embodiments.

What is claimed is:

1. A cushion pin interposed between a work and a die cushion, the cushion pin comprising:

a pillar member; and an elastic material that is arranged coaxially with respect to the pillar member and produces a pushing force in an axial direction of the pillar member, wherein the pillar member comprises: a bolt member attached to a first member; a sliding member disposed between a head of the bolt member and an end face of the first member; and a second member attached to an opposite end of the sliding member relative to the first member, wherein the first member, the bolt member, the sliding member and the second member are coaxially aligned, and wherein the elastic material is disposed around said bolt member and in said sliding member.

2. The cushion pin as claimed in claim 1, wherein the sliding member is slidable relative to the bolt member and the first member.

3. The cushion pin as claimed in claim 1, further comprising a spacer disposed between the elastic material and the end face of the first member.

4. A load supplying device, which is interposed between a cushion pin and a die cushion pad, comprising:

a first member fixed to an upper face of the die cushion pad;

a pillar member; and an elastic member that is arranged coaxially with respect to the pillar member and produces a pushing force in an axial direction of the pillar member, wherein the pillar member comprises: a bolt member attached to a first member; a sliding member is disposed between a head of the bolt member and an upper face of the first member; and a second member attached to an opposite end of the sliding member relative to the first member;

wherein the bolt member, the sliding member and the second member are coaxially aligned, and wherein the elastic member is disposed around the bolt member and in the sliding member.

5. A die cushion, wherein the load supporting device as claimed in claim 4 is fixed to the upper face of the die cushion pad.

6. A press machine using the die cushion as claimed in claim 5.

7. A load supporting device, which is interposed between a cushion pin and a die cushion pad, comprising:

a pillar member; and an elastic member that is arranged coaxially with respect to the pillar member and produces a pushing force in an axial direction of the pillar member, wherein the pillar member comprises: a bolt member attached to an upper face of the die cushion pad; a sliding member disposed between a head of the bolt member and the upper face of the die cushion pad; and an upper member attached to an opposite end of the sliding member relative to the upper face of the die cushion pad, wherein the bolt member, the sliding member and the upper member are coaxially aligned, and wherein the elastic member is disposed around the bolt member and in the sliding member.

8. A die cushion, wherein the load supporting device as claimed in claim 7 is fixed to the upper face of the die cushion pad.

9. A press machine using the die cushion as claimed in claim 8.

* * * * *